US008301277B2

(12) United States Patent
Jones

(10) Patent No.: US 8,301,277 B2
(45) Date of Patent: Oct. 30, 2012

(54) DYNAMIC DISPLAY OF A GAME SPREAD

(76) Inventor: David D. Jones, St. Paul, MN (US)

( * ) Notice: Subject to any disclaimer, the term of this patent is extended or adjusted under 35 U.S.C. 154(b) by 1541 days.

(21) Appl. No.: 11/809,143

(22) Filed: May 31, 2007

(65) Prior Publication Data

US 2007/0288846 A1 Dec. 13, 2007

Related U.S. Application Data

(60) Provisional application No. 60/811,629, filed on Jun. 7, 2006.

(51) Int. Cl.
*G06F 19/00* (2011.01)

(52) U.S. Cl. ..... 700/91; 707/104.1; 345/440; 714/742

(58) Field of Classification Search ..... 700/91
See application file for complete search history.

(56) References Cited

U.S. PATENT DOCUMENTS 7,620,466 B2 * 11/2009 Neale et al. ..... 700/91
2002/0143790 A1 * 10/2002 Qian ..... 707/104.1
2005/0001837 A1 * 1/2005 Shannon ..... 345/440
2005/0050423 A1 * 3/2005 Yasukawa et al. ..... 714/742
2007/0126736 A1 * 6/2007 Tolle et al. ..... 345/440

OTHER PUBLICATIONS

Westfall, P., "Graphical Presentation of a Basketball Game", from *The American Statistician*, vol. 44, No. 4, Nov. 1990, pp. 305-307.

* cited by examiner

*Primary Examiner* — Paul A D'Agostino
(74) *Attorney, Agent, or Firm* — Kinney & Lange, P.A.

(57) ABSTRACT

A display for conveying game information includes a bar graph and a coded legend. The bar graph has a first axis corresponding to spread values and a second axis corresponding to game time. Individual bars are plotted on the bar graph to indicate a spread between two scores at associated game times for a given game. The coded legend defining a first legend code indicating that a selected group of one or more players is active and a second legend code indicating that the selected group of one or more players is inactive. The individual bars plotted on the bar graph are coded according to the coded legend to associate the spread with activity and inactivity of the selected group of one or more players in the game.

10 Claims, 7 Drawing Sheets

30

31A

| WOLVES | ASSIST | BLOCK | FOUL | MISSED FOUL | FOUL POINT | 3-POINT | BASKET |
|---|---|---|---|---|---|---|---|
| PLAYER 1 | 2 | | 1 | 2 | 2 | 6 | 6 |
| PLAYER 2 | | | 2 | | 5 | 6 | 16 |
| PLAYER 3 | 4 | | 2 | 2 | 3 | | 8 |
| PLAYER 4 | | 3 | 5 | | | | 6 |
| PLAYER 5 | 4 | | | | 1 | 3 | 8 |
| PLAYER 6 | | | | | | | |
| PLAYER 7 | | 2 | 1 | | 1 | | 4 |
| PLAYER 8 | | | 1 | | | 3 | 2 |
| PLAYER 9 | | | | | | | |
| PLAYER 10 | | | | | | | |

32A

31B

| HEAT | BASKET | 3-POINT | FOUL POINT | MISSED FOUL | FOUL | BLOCK | ASSIST |
|---|---|---|---|---|---|---|---|
| PLAYER 1 | 8 | | 2 | 1 | 3 | | 3 |
| PLAYER 2 | 10 | 9 | 3 | | 2 | | |
| PLAYER 3 | 12 | | 5 | 2 | 1 | | 1 |
| PLAYER 4 | 6 | | | 2 | 2 | 4 | |
| PLAYER 5 | 2 | 3 | 1 | 2 | 4 | 1 | 2 |
| PLAYER 6 | 2 | | 1 | | | | |
| PLAYER 7 | 6 | 3 | | | | | |
| PLAYER 8 | 2 | | | | | | |
| PLAYER 9 | | | | | | | |
| PLAYER 10 | | | | | | | |

32B

Fig. 3A

| | SCORE | | |
|---|---|---|---|
| TIME | WOLVES | HEAT | SPREAD |
| 8:20 | 77 | 73 | 4 |
| 8:15 | 77 | 75 | 2 |
| 8:10 | 80 | 75 | 5 |
| 8:05 | 80 | 75 | 5 |
| 8:00 | 80 | 75 | 5 |
| 7:55 | 80 | 75 | 5 |
| 7:50 | | | |
| 7:45 | | | |
| 7:40 | | | |
| 7:35 | | | |
| 7:30 | | | |

38

Fig. 3D

DYNAMIC DISPLAY OF A GAME SPREAD

CROSS-REFERENCE TO RELATED APPLICATION(S)

This application claims priority to U.S. Provisional Pat. App. No. 60/811,629; filed Jun. 7, 2006, which is hereby incorporated by reference in its entirety.

BACKGROUND

The present invention relates to the real-time display of the spread between competing teams' scores during the course of a game.

Viewing broadcast sporting events, accompanied by commentary, is a popular pastime. Analysts add to viewer enjoyment by observing and remarking on the ebb and flow of the contest. It is desired to provide unique viewing tool to assist commentators and to add to viewing enjoyment for viewers.

SUMMARY

A display for conveying game information includes a bar graph and a coded legend. The bar graph has a first axis corresponding to spread values and a second axis corresponding to game time. Individual bars are plotted on the bar graph to indicate a spread between two scores at associated game times for a given game. The coded legend defining a first legend code indicating that a selected group of one or more players is active and a second legend code indicating that the selected group of one or more players is inactive. The individual bars plotted on the bar graph are coded according to the coded legend to associate the spread with activity and inactivity of the selected group of one or more players in the game.

BRIEF DESCRIPTION OF THE DRAWINGS

FIG. 3A is an enlarged view of a primary region of the working display of FIG. 2.

FIG. 3D is an enlarged view of a scrolling clock of the working display of FIG. 2.

DETAILED DESCRIPTION

The present invention provides viewers with a real-time progression of the spread between two teams' scores over the course of a game. The present invention is suitable for any game in which score is kept. It is ideal for basketball (international or American, professional, college or any other level). For simplicity, the present description is in terms of basketball. As used herein, the term "spread" refers to a numerical difference between two game values, for example, between team scores. While discussed in the context of viewers watching a broadcast of a game, it will be appreciated that the event could be viewed on television, over the Internet, in a theater broadcast, or via some other media without affecting the applicability of this invention.

In general, a display according to the present invention is a simple graphic seen on a video screen (e.g., a television). The display reflects a spread between game values, such as the scores of teams engaged in the course of a competitive game. There are myriad alternative perspectives from which the display can be presented to viewers: For example, bars in a spread graphic can be color-coded red when a particular player (or collection of players) is in the game and blue when not. Bars in the spread graphic can be color-coded blue before a player's injury and green after. Bars in the spread graphic can be color-coded red before a player's first foul, blue after the player's second foul, yellow after the third, and so forth. When a player is in the game and the bars in the spread graphic are color-coded red (as in the first example) they can be displayed with a different shade or pattern when the player scores or blocks a shot. Each of these alternatives will allow commentators to remark on the impact of these various events on the flow of the game. It should be noted that while the current invention is discussed in the context of basketball, it can be equally applied to any competition in which score is kept.

Figure 1:
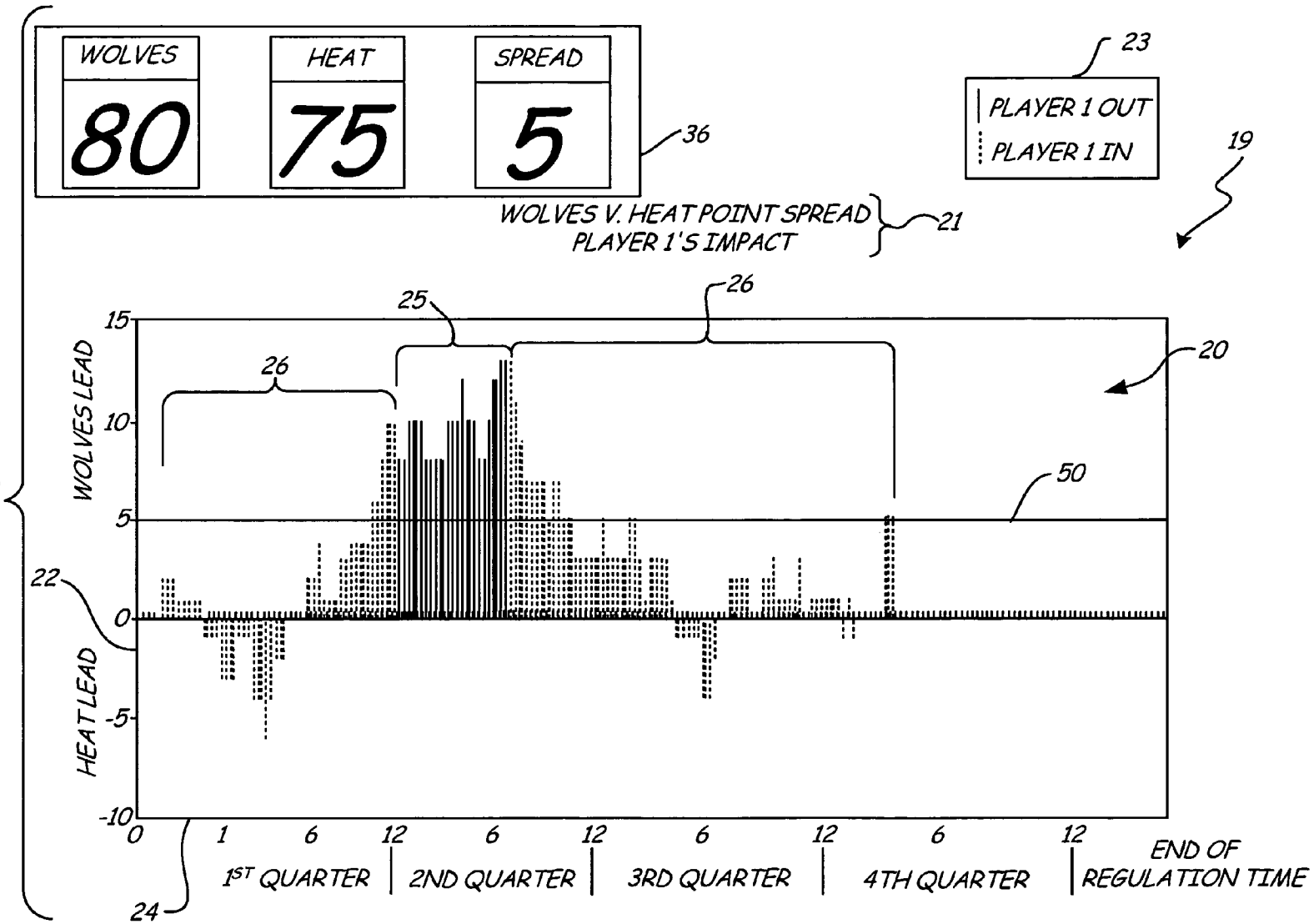
FIG. 1 is a display according to the present invention.

FIG. 1 is an example of a display (19) that a viewer could see on a video screen with the present invention. More or less information than is illustrated in FIG. 1 could be provided in alternative embodiments of the display (19). As shown in FIG. 1, the display (19) includes a graphic (20) of a spread between two teams' scores over the course of a game thus far (i.e., at any moment during the game). A heading (21), which reads "Wolves v. Heat Point Spread: Player 1's Impact," informs a viewer of a principal whose impact on the spread is being considered. In the illustrated embodiment, "Player 1" is the principal. In practice, an actual player's name would be shown in heading (21). In general, however, the principal can be an individual player, a combination of players from the same and/or opposing teams, an event (e.g., a combination of fouls, or an injury), or any other event or game value that commentators or viewers might wish to consider in conjunction with the change (or lack thereof) of the spread in the teams' scores. There is essentially no limit to the combination of affecting factors that can be considered simultaneously: several players, foul situations, injuries, periods of play, etc.

In FIG. 1 the fluctuating spread is plotted on the vertical axis of the graph (22). One team, "Wolves", is associated with a positive spread in the score; the other, "Heat", with a negative spread. The home team can be associated with a positive spread, or vice-versa. The horizontal axis marks a progression or timeline of the game (24) from beginning to end (including any overtime played beyond regulation time). The embodiment shown in FIG. 1 relates to a game played in the National Basketball Association, where there are four periods per game, 12 minutes each. In college basketball (primarily played under the auspices of the National Collegiate Athletic Association—NCAA), there are two halves per game, 20 minutes each. International and high school rules are different still. Modifying the presentation of the graphic (20) to account for these differences does not change the nature of the invention. A legend (23) shown next to the graph (22) conveys additional information regarding the graphic (20).

In FIG. 1, the spread in the score thus far is shown in the graphic (20) as a bar graph having coded regions that indicate whether Player 1 is active, as shown in regions (26) with solid bars, or inactive, as shown in regions (25) with dashed bars. A particular selected player with which coded regions of the graphic (20) are associated can be called a "principal". The legend (23) identifies the solid-bar regions (26) and the dashed-bar regions (25) by code. The coded regions (25 and 26) of the graphic (20) can be color coded according for easy identification by viewers. By displaying the regions (25 and 26) in FIG. 1 in contrasting colors (e.g., red and green), the impact of the principal (Player 1 in FIG. 1) on the spread can be easily, yet dramatically demonstrated to viewers. In further embodiments, individual graph bars plotted on the spread graphic (20) can indicate scores made, assists, shots blocked, steals, turnovers, fouls committed, being fouled, injuries, etc. by a particular player as well as the total spread in various embodiments, such as with further coding for those individual bars on the graphic (20). In such cases, further patterns or additional color-coding can be provided with the legend (23). FIG. 1 can be created and displayed in conjunction with a commentator's analysis for broadcast, helping to visually convey information to viewers in a clear manner. The display (20), such as shown in FIG. 1, could be generated throughout the course of the game in real time, allowing for a dynamic, running commentary on various factors affecting the progress of the game.

Figure 2:
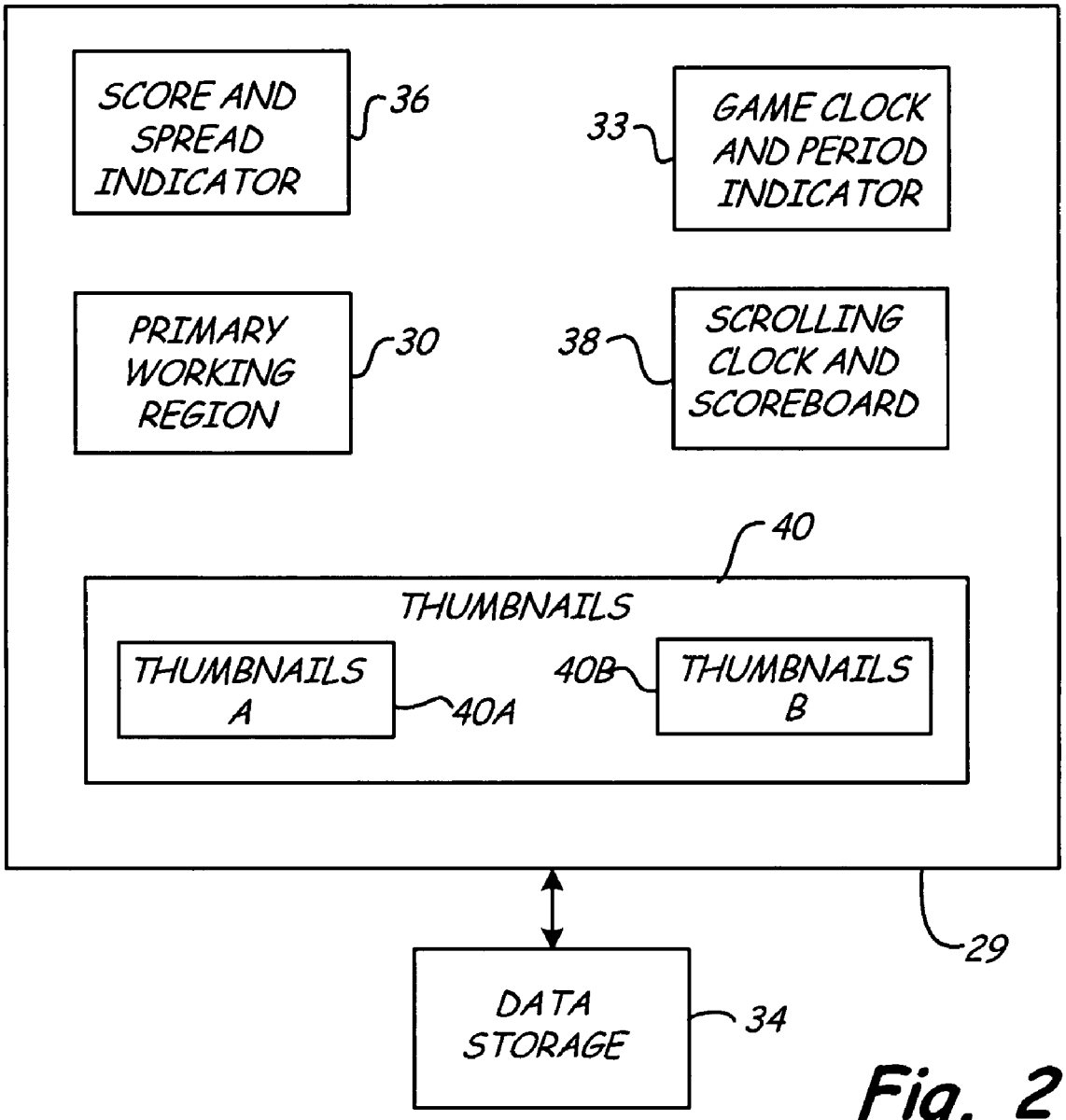
FIG. 2 is a block diagram of a working display according to the present invention.

FIG. 2 is a block diagram of an exemplary working display (29) that can be viewed by the operator charged with generating various graphics for viewers (e.g., graphic 20 shown in FIG. 1). FIG. 2 is demonstrative of the working display (29), but does not limit what might be on that screen in alternate embodiments. FIGS. 3A-3E are enlarged views of various aspects of the working display (29) of FIG. 2. It should be noted that the features illustrated in FIGS. 2-3E could be implemented using a conventional personal computer that is operably connected to one or more displays.

As shown in FIG. 2, the working display (29) includes a primary region (30). FIG. 3A is an enlarged view of the primary region (30) of the working display (29). In the illustrated embodiment team rosters (31A and 32B) and associated game statistics (32A and 32B) are shown in the primary region (30), although as explained below other data can appear in the primary region (30). For ease of set-up, whole league rosters can be stored in a linked file, not shown, and team rosters (31A and 31B) can each be automatically filled in with relevant data before a game begins. Players can be identified by name, jersey number, etc. For generality, players on each team are shown in FIG. 2 simply as "Player 1" to "Player 10" rather than by name. Players currently in the game are highlighted on each roster (31A and 31B). As players enter or leave the game, the highlighting on the team rosters (31) can change in real-time, either automatically or through manual operator command. The operator generally need only be concerned with those players highlighted.

Information typical of that to be tracked for each player on the rosters (31A and 31B) is shown at the regions (32A and 32B), which are shown as grids. For each individual on each roster (31A and 31B), a box in the grids of regions (32A and 32B) can be checked when the associated player makes a 2-point (listed simply as "basket") or 3-point basket, makes or misses a foul shot, commits a foul, blocks a shot or makes an assist. Appropriate grid boxes in the regions (32A and 32B) can be checked using a mouse or other conventional type of user interface system. The operator need only click the appropriate grid cell (e.g., Player 1 for the Wolves scores a two point basket) as events occur during the game. Clicking a box adds to the count of Assists, or Blocked Shots, etc. or increments the player's scores for foul points, 2- or 3-point baskets. This simplifies the amount of effort required by the operator, and can help automate the overall system. Scoring entered by the operator via the grids in the regions (32A and 32B) will automatically affect the total score and the spread in scoring, and in turn show up on any subsequent graphic (20) automatically. The timing of other events (e.g., missing a foul shot, or blocking a shot) can be automatically stored or logged when the operator clicks the corresponding box in the grids of the regions (32A and 32B) for easy retrieval if factors associated with those other events are to be considered in relation to their effect on the spread.

Figure 3B:
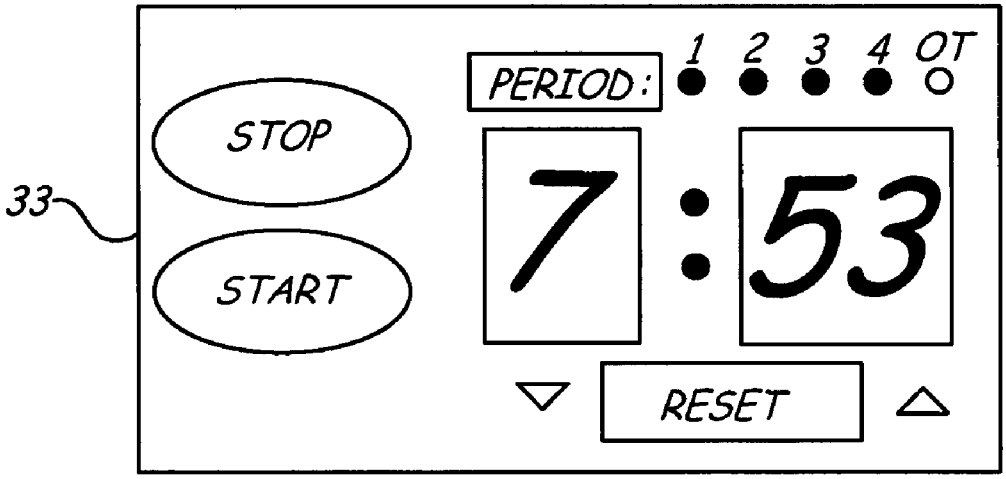
FIG. 3B is an enlarged view of a game clock and period indicator of the working display of FIG. 2.

As shown in FIG. 2, the working display (29) includes a game clock and period indicator (33). FIG. 3B is an enlarged view of the game clock and period indicator (33). When the game stops on the playing floor, the operator can stop the clock by interacting with start/stop buttons of the indicator (33). The indicator (33) also enables the operator to reset the game clock, to assure that the timing of events in reflected on the working display (29) agrees with those on the floor of the game. Likewise, there are buttons on the indicator (33) for easily correcting or adjusting the game time, score, or game event because of rulings made on the game floor or because of operator error.

Game data is exported automatically from the working display (29) to data storage (34). This generates a record or log of player-by-player game data over the course of the game (i.e., who scored, was fouled, etc. and when), all available immediately for display on the display (19), but also for storage in an official game information database which can be made accessible for subsequent analysis or display, such as for retrospective video viewing or for statistical analysis of player performance and impact.

Figure 3C:
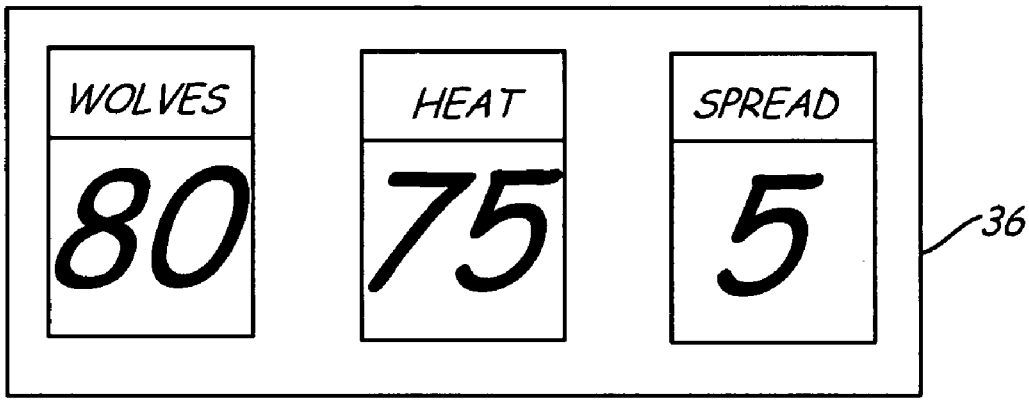
FIG. 3C is an enlarged view of a score and spread indicator of the working display of FIG. 2.

The working display (29) shown in FIG. 2 also includes a score and spread indicator (36). FIG. 3C is an enlarged view of the score and spread indicator (36), which displays each teams current score and the current spread, which is also a part of the display (19).

A scrolling clock and scoreboard (38) is also included with the working display (29) shown in FIG. 2. FIG. 3D is an enlarged view of the scrolling clock and scoreboard (38) of the working display (29). The scrolling clock and scoreboard (38) is a table of game data with rows that correspond to game times and columns that indicate scores for each team and the spread. The rows of the scrolling clock (38) ratchet down at specified timed intervals (shown, for example, as 5 second intervals in FIG. 3D), such that the score of each team and the spread of the game score is shown for each time interval during the game. Data on the scrolling clock and scoreboard (38) is generated automatically as the operator clicks on boxes in the primary working region (30) during the course of the game. The scrolling clock and scoreboard (38) provides a record or log that makes revisions and corrections simpler for an operator utilizing the working display (29). The total score and spread are linked between the scrolling clock and scoreboard (38) and the graphic (20), such that values displayed by each are identical for each instant during the game.

Figure 3E:
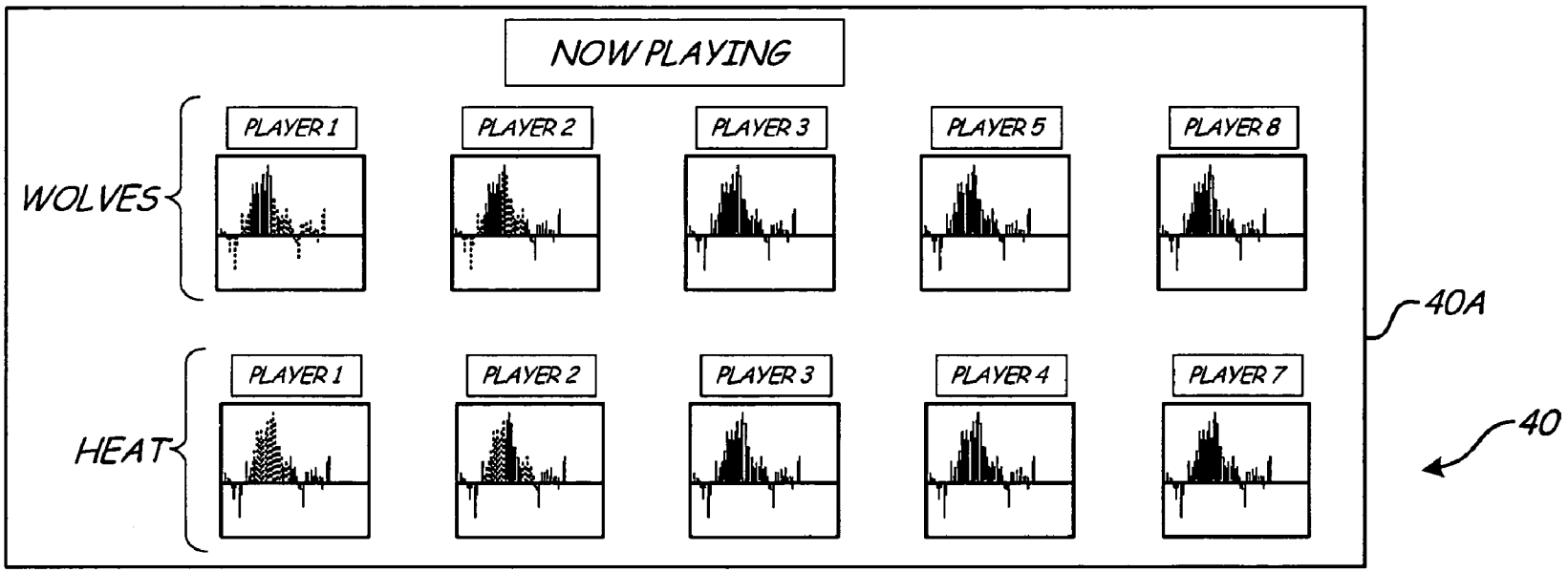
FIGS. 3E and 3F are enlarged views of thumbnail images of the working display of FIG. 2.
Figure 3F:
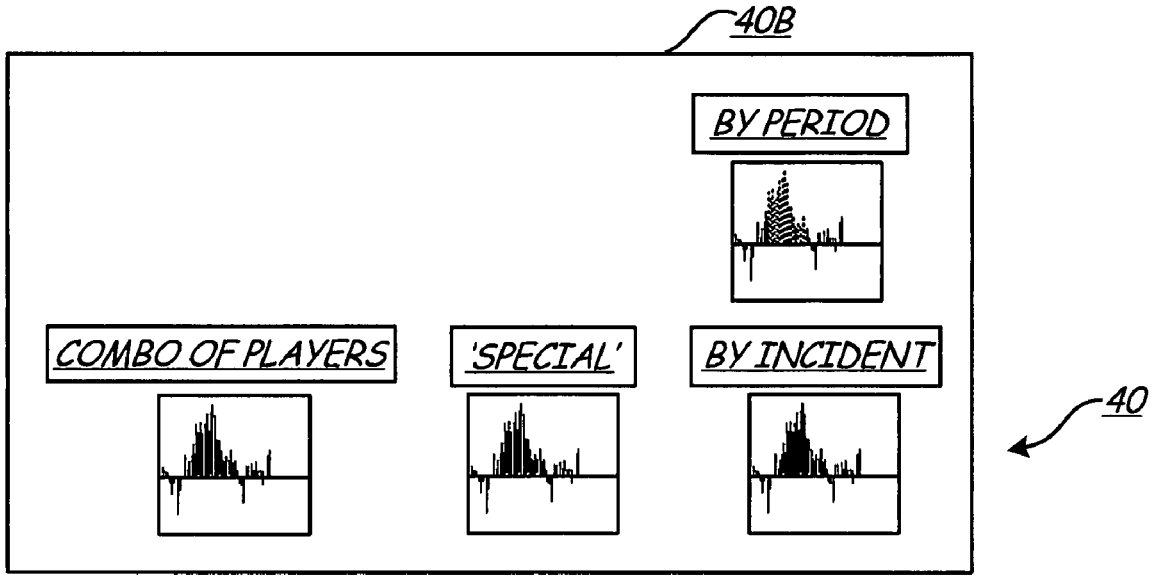

Many of the graphics, such as the graphic (20) shown in FIG. 1, that might be displayed or broadcast to a viewer during the course of a game can be easily anticipated (e.g., ones tracking certain players or sets of players). Some of these are shown at the bottom of the working display (29) in FIG. 2 in the form of "thumbnail" images (40), which can be arranged in groups (40A and 40B). FIGS. 3E and 3F are enlarged views of the thumbnail images (40) of the working display (29). The thumbnail images (40) are miniature representations of specific graphics, developing in real time over the course of the game as the operator follows the game and enters data via clicks on the primary working region (30) of the working display (29). Each of the thumbnail images (40) can be associated with a particular anticipated spread perspective, for instance, a different principal. The thumbnail images (40) can be grouped for operator convenience, for example, one group (40A) can include thumbnail images (40) for all the players currently playing for each team (FIG. 3E).

Thus, if a commentator wishes to view the point spread thus far in the game from a perspectives represented by one of the thumbnail images (40), the operator need only to click on an appropriate one of the thumbnail images (40) on the working display (29) to instantaneously produce an associated graphic and transmit that graphic to a desired display.

Of course, not every circumstance can be anticipated (e.g., the timing of fouls, injuries, or the coach throwing a chair across the playing floor). These graphics can be generated as called for by the operator. Another group of thumbnail images (40B) can include thumbnail images (40) associated with other principals like combinations of players, incidents, game periods, or special factors selected by the operator (FIG. 3F). This other group of thumbnail images (40B) allows the operator to generate unique graphics quickly.

Historic graphics may also be of interest. Data on spreads from earlier games generated using the working display (29) will generally be saved and stored on a routine basis in data storage (34). Point spreads over the course of all earlier games, home games, or games chosen based on other times and circumstances can easily be generated and displayed using the working display (29), and can be compared to the present game. Graphics of data from previous games might also be displayed for viewers in rapid serial order, about a fraction of a second each, generating a time-lapse "movie" showing how the spread has fared over the course of times, such as over the course of many games.

Graphics, such as the graphic (20) shown in FIG. 1, can routinely show the spread relative to a zero (0) base line (e.g., the zero value of the vertical axis in the graphic (20)), which team essentially shows which team is leading in scoring and by how much. A gambling spread line (50) can be superimposed or otherwise shown on the graphic (20) to indicate a betting line on the game. The term "gambling spread" refers to a generally a priori value index of an anticipated game outcome that is used to bet against and to increase precision of the betting process beyond simple binary win/lose scenarios. The spread relative to this possibly non-zero line (50) will be of interest to many viewers. It should be noted that gambling spread can vary, and may change over time. The graphic (20) can be update to reflect such gambling spread changes. Moreover, multiple gambling spreads may be available for a single game, and a range of lines (50) can be displayed on the graphic (20) at the same time. In an alternative embodiment, the base line of the vertical axis of the graphic (20) can have a non-zero value that corresponds to a gambling spread.

Statistics on spreads from previous games will amount to a rich data set. The present invention has utility beyond use with broadcasts. For example, individual players and teams may want to use them in negotiations to argue over the player's value to the team.

Although the present invention has been described with reference to preferred embodiments, workers skilled in the art will recognize that changes may be made in form and detail without departing from the spirit and scope of the invention.

The invention claimed is:

1. A method of displaying information about a game, the method comprising:

gathering game data in computer-readable memory;

determining a point spread between two team scores as a function of the game data;

selecting a distinguishing game event, wherein the distinguishing game event is selected before or after an end of the game;

establishing a first graphical coding system that indicates the distinguishing game event over one or more lengths of game time; and generating and displaying a first graphic that indicates the point spread over time, wherein the graphic is generated using a computer contemporaneously with the selection of the distinguishing game event and is coded over at least one corresponding length of game time according to the first graphical coding system; and generating and displaying a second graphic that indicates current scores and a current point spread.

2. The method of claim 1, wherein the distinguishing game event is selected from the group consisting of a status of a selected player being in or out of the game, a status of a selected group of players being in or out of the game, a selected player scoring, a selected player performing a steal, a selected player performing a turnover, a selected player rebounding, a selected player fouling and a selected player being fouled.

3. The method of claim 1, wherein the step of gathering game data further comprises:

performing a single-click operation on a cell of a grid having cells for entering game data associated with any player identified by a team roster to enable data entry based upon one or more distinguishing game event values associated with each cell.

4. The method of claim 1, wherein the step of gathering game data in computer-readable memory includes correlating entered data with a scrolling clock to facilitate determining the point spread at periodic game time intervals.

5. The method of claim 1, wherein the first graphical coding system indicates the distinguishing game event by color-coding, and wherein the graphic is generated and color-coded before the end of the game.

6. The method of claim 5, wherein the first graphical coding system color-codes regions of the graphic with a plurality of colors, with a boundary of each color-coded region defined by a number of fouls committed by a selected player.

7. The method of claim 1, wherein the step of selecting a distinguishing game event includes selecting from a list of a plurality of available distinguishing game events.

8. The method of claim 1, wherein the step of gathering game data in computer-readable memory includes:

providing a list identifying available players;

providing a grid having cells for entering game data associated with any of the players identified by the list; and entering data into a given one of the cells of the grid during the course of the game with a single click action based upon one or more defined game values associated with each cell, wherein the entered data is instantaneously reflected in the graphic.

9. The method of claim 1 and further comprising:

selecting an additional distinguishing game event;

establishing a second graphical coding system that indicates the additional distinguishing game event; and updating the graphic that indicates the point spread over time, wherein the updated graphic is generated using the computer and is coded according to the second graphical coding system.

10. The method of claim 9 and further comprising:

generating a time lapse movie through display in serial succession of a plurality of updates of the graphic.

* * * * *

UNITED STATES PATENT AND TRADEMARK OFFICE

CERTIFICATE OF CORRECTION

PATENT NO. : 8,301,277 B2
APPLICATION NO. : 11/809143
DATED : October 30, 2012
INVENTOR(S) : David D. Jones It is certified that error appears in the above-identified patent and that said Letters Patent is hereby corrected as shown below:

In the Specification

Col. 5, Line 41
Delete "update"
Insert --updated--

Signed and Sealed this
Twenty-sixth Day of November, 2013

Margaret A. Focarino

Margaret A. Focarino
*Commissioner for Patents of the United States Patent and Trademark Office*